US009552913B2

(12) United States Patent
Daibo

(10) Patent No.: US 9,552,913 B2
(45) Date of Patent: Jan. 24, 2017

(54) SUPERCONDUCTING COIL AND SUPERCONDUCTING DEVICE

(71) Applicant: FUJIKURA LTD., Koto-ku, Tokyo (JP)

(72) Inventor: Masanori Daibo, Sakura (JP)

(73) Assignee: FUJIKURA LTD., Tokyo (JP)

( * ) Notice: Subject to any disclaimer, the term of this patent is extended or adjusted under 35 U.S.C. 154(b) by 245 days.

(21) Appl. No.: 14/460,991

(22) Filed: Aug. 15, 2014

(65) Prior Publication Data

US 2014/0357492 A1 Dec. 4, 2014

Related U.S. Application Data

(63) Continuation of application No. PCT/JP2013/056129, filed on Mar. 6, 2013.

(30) Foreign Application Priority Data

Mar. 6, 2012 (JP) ..... 2012-049411

(51) Int. Cl.
*H01F 6/06* (2006.01)
*H01F 6/04* (2006.01)
*H01F 5/02* (2006.01)

(52) U.S. Cl.
CPC *H01F 6/06* (2013.01); *H01F 5/02* (2013.01); *H01F 6/04* (2013.01)

(58) Field of Classification Search
CPC ..... H01F 6/06; H01F 5/02
See application file for complete search history.

(56) References Cited

U.S. PATENT DOCUMENTS 5,396,205 A 3/1995 Takahashi et al.
2010/0148625 A1 6/2010 Okazaki et al.

FOREIGN PATENT DOCUMENTS

| | | | |
|---|---|---|---|
| JP | 6-151168 | A | 5/1994 |
| JP | 11-176629 | A | 7/1999 |
| JP | 11-186025 | A | 7/1999 |
| JP | 2007037343 | A | 2/2007 |
| JP | 2009-44013 | A | 2/2009 |
| JP | 2009-188065 | A | 8/2009 |
| JP | 2010-171152 | A | 8/2010 |
| RU | 2109361 | C1 | 4/1998 |

OTHER PUBLICATIONS

Machine Translation of JP 2009-044013, pp. 1-9.*
Machine Translation of JP2010-171152, pp. 1-12.*
Machine Translation of JP2009-188065, pp. 1-12.*
Machine Translation of JP11-186025, pp. 1-13.*
Takao T et al: "Mechanical Loss and Bobbin Materials in AC Superconducting Coil Under AC Magnetic Field", IEEE Transactions on Applied Superconductivity, vol. 21, No. 3, Jun. 1, 2011, pp. 2420-2423, DOI:10.1109/TASC.2010.2091240.

(Continued)

*Primary Examiner* — Colleen Dunn
(74) *Attorney, Agent, or Firm* — Sughrue Mion, PLLC

(57) ABSTRACT

A superconducting coil includes: first and second pancake coils that are formed by winding a superconducting wire, are stacked in a thickness direction, and are adjacent to each other; and a cooling substrate that is provided in contact with an end surface of the first pancake coil and is separable into a plurality of cooling plates.

7 Claims, 5 Drawing Sheets

(56) References Cited

OTHER PUBLICATIONS

Communication dated Nov. 5, 2015 from the European Patent Office in counterpart application No. 13758274.8.
Communication dated Dec. 8, 2015 from the Russian Patent Office in counterpart application No. 2014136146/07.
Communication dated Aug. 25, 2015 from the European Patent Office in counterpart European Application No. 13758274.8.
Communication dated Mar. 17, 2015 from the Japanese Patent Office in counterpart application No. 2014-503880.
International Search Report for PCT/JP2013/056129 dated Jun. 18, 2013 [PCT/ISA/210].
Written Opinion for PCT/JP2013/056129 dated Jun. 18, 2013 [PCT/ISA/237].
Communication dated May 6, 2016, from the Russian Patent Office in counterpart application No. 2014136146.
Communication dated Nov. 18, 2014 from the Japanese Patent Office in counterpart application No. 2014-503880.
English-language translation of JP 2010171152 of record, 2015.
English-language translation of JP 2009188065 of record, 2015.
English-language translation of JP 11186025 of record, 2015.

* cited by examiner

SUPERCONDUCTING COIL AND SUPERCONDUCTING DEVICE

CROSS REFERENCE TO RELATED APPLICATIONS

This application is a continuation application based on a PCT Patent Application No. PCT/JP2013/056129, filed Mar. 6, 2013, whose priority is claimed on Japanese Patent Application No. 2012-049411, filed on Mar. 6, 2012, the entire content of which are hereby incorporated by reference.

BACKGROUND OF THE INVENTION

Field of the Invention

The present invention relates to a superconducting coil and a superconducting device, and in particular, to a superconducting coil that includes a plurality of laminated pancake coils and is used in a superconducting device, such as a superconducting magnet or a superconducting rotary machine, and a superconducting device including the superconducting coil.

Description of the Related Art

In a superconducting device, such as a superconducting magnet or a superconducting motor, a plurality of laminated pancake type superconducting coils may be used. Various structures, such as a structure in which laminated pancake type superconducting coils are cooled by heat conduction from a freezing machine or a structure in which laminated pancake type superconducting coils are cooled by coolant such as helium gas, have been suggested.

As a conventional example of a pancake type superconducting coil, a superconducting coil impregnated with resin for electromagnetic force reinforcement and a superconducting coil integrated by curing a glass fiber reinforced sheet, which is interposed between laminated pancake coils and contains semi-cured resin, is known (refer to Japanese Unexamined Patent Application, First Publication No. H6-151168).

FIG. 4 shows a conventional example of a superconducting coil integrated by curing semi-cured resin contained in a glass fiber reinforced sheet. A superconducting coil 100 in this example includes a vacuum container 101, a heat shield container 102 provided inside the vacuum container 101, and a coil laminate 103 provided so as to be surrounded by the heat shield container 102. In the coil laminate 103, a plurality of pancake coils 105 formed by winding a superconducting wire into a pancake shape are laminated vertically and coaxially along a body portion 107 of a bobbin 106. The coil laminate 103 is housed inside the heat shield container 102. In the superconducting coil 100, a glass fiber reinforced sheet 108 is inserted between laminated pancake coils 105, and the laminated pancake coil 105 and the glass fiber reinforced sheet 108 are bonded together. A freezing machine 109 passing through the vacuum container 101 and the heat shield container 102 in a vertical direction is provided above the bobbin 106. The superconducting wire that forms the pancake coil 105 can be cooled by conduction cooling using the freezing machine 109.

In the conventional superconducting coil 100 in which the glass fiber reinforced sheet 108 and the pancake coil 105 are integrated as shown in FIG. 4, however, when one or more of the pancake coils 105 deteriorate, the entire superconducting coil 100 should be manufactured again. In this case, there is a risk of serious damage in terms of time and cost.

In particular, when a rare earth element-based oxide superconducting wire is used, it is generally difficult to detect the occurrence of the quench. For this reason, if a part of the superconducting wire that forms the pancake coil 105 is burnt, the entire superconducting coil 100 should be remanufactured. Therefore, there is a problem in that serious damage is caused in terms of time and cost.

In view of the damage in terms of time and cost, it is also possible to adopt the superconducting coil 100 in which the glass fiber reinforced sheet 108 and the pancake coil 105 are not integrated. However, in order to ensure the mechanical strength of the superconducting coil 100 and increase the thermal stability of the entire coil, it is desirable to integrate the pancake coil 105 impregnated with resin and the glass fiber reinforced sheet 108.

The present invention has been made in view of the above, and it is an object of the present invention to provide a superconducting coil, which includes a plurality of pancake coils formed by winding a superconducting wire and has a structure in which, even if a problem occurs in one or more of the assembled pancake coils for some reason, the pancake coil in which the problem has occurred can be replaced, and a superconducting device including the superconducting coil.

SUMMARY

In order to solve the above-described problem, a superconducting coil according to a first aspect of the present invention includes: first and second pancake coils that are formed by winding a superconducting wire, are stacked in a thickness direction, and are adjacent to each other; and a cooling substrate that is provided in contact with an end surface of the first pancake coil and is separable into a plurality of cooling plates.

According to the superconducting coil described above, since the cooling substrate disposed on the end surface of the pancake coil can be separated into a plurality of cooling plates, the laminated pancake coils can be separated from each other by separating the plurality of cooling plates that form the cooling substrate from each other. For this reason, it is possible to remove a pancake coil in which a problem has occurred and replace the pancake coil with another new pancake coil. That is, it is possible to repair the superconducting coil without wasting a pancake coil in which no problem has occurred. Therefore, compared with the conventional technique in which all pancake coils are replaced when a problem occurs in one or more of the pancake coils, it is possible to repair the superconducting coil at low cost without creating waste.

In addition, a bonding element may be further provided. The cooling substrate may be interposed between the first and second pancake coils. The bonding element may bond the cooling substrate and the first pancake coil to each other and bond the cooling substrate and the second pancake coil to each other. The first and second pancake coils may be separable from each other by separation between the plurality of cooling plates.

In this case, even if the cooling plate and the pancake coil are bonded and integrated by the resin impregnated in the pancake coil in contact with the cooling plate, the laminated pancake coils can be easily separated from each other by separating the cooling plates from each other since the stacked cooling plates can be separated. For this reason, it is possible to ensure good thermal conductivity between the pancake coil and the cooling plate and to replace only the pancake coil in which a problem has occurred. Therefore, it is possible to minimize the damage in terms of time and cost of the superconducting wire and the pancake coil.

In addition, the first pancake coil and at least a pair of upper and lower cooling plates may be fixed by the bonding element, and the second pancake coil and at least a pair of upper and lower cooling plates may be fixed by the bonding element.

In addition, a freezing machine connected to the cooling substrate through a heat transfer member and a heat transfer connection member, which is provided in each of the plurality of cooling plates and is connected to the heat transfer member, may be further provided.

In this case, each plurality of cooling plates that forms the cooling substrate can be cooled by the freezing machine through the heat transfer connection member. For this reason, even in a structure in which cooling plates are simply laminated so as to overlap each other, each cooling plate can be efficiently cooled by the freezing machine, and each pancake coil connected to the cooling plate through the heat transfer connection member can be cooled efficiently. Therefore, it is possible to provide a superconducting coil having the same cooling efficiency as a conventional superconducting coil.

In addition, a bobbin including a pair of upper and lower flange portions, between which the first and second pancake coils are interposed in the thickness direction, and a body portion, which is provided between the pair of upper and lower flange portions and is inserted in the first and second pancake coils, may be further provided. Thermal expansion coefficients of the flange portions and the body portion may be larger than thermal expansion coefficients of the first and second pancake coils and a thermal expansion coefficient of the cooling substrate.

In addition, a bobbin including a pair of upper and lower flange portions, between which the first and second pancake coils are interposed in the thickness direction, and a body portion, which is provided between the pair of upper and lower flange portions and is inserted in the first and second pancake coils, may be further provided. The first and second pancake coils and the cooling substrate may be interposed between the pair of upper and lower flange portions so as to be compressed in the thickness direction by an amount larger than an amount of shrinkage in the thickness direction of the first and second pancake coils and the cooling substrate during cooling of the first and second pancake coils by the cooling substrate.

A superconducting device according to a second aspect of the present invention includes: the superconducting coil described above; an inner container surrounding the superconducting coil; a vacuum container surrounding the inner container; and a freezing machine passing through the vacuum container and the inner container. The cooling substrate is connected to a tip of the freezing machine, which extends to an inside of the inner container, through a heat transfer member. According to the superconducting device described above, it is possible to provide a superconducting device which includes a superconducting coil having a plurality of laminated pancake coils and in which the pancake coil can be cooled through the cooling substrate provided in contact with the pancake coil.

In addition, since the cooling substrate disposed on the end surface of the pancake coil is configured to include a plurality of cooling plates, the laminated pancake coils can be separated from each other by separating the plurality of stacked cooling plates from each other. That is, it is possible to remove only a pancake coil, in which a problem has occurred, among the assembled pancake coils and replace the pancake coil with another new pancake coil. For this reason, it is possible to minimize the damage in terms of time and cost of the superconducting wire and the pancake coil and to minimize the number of steps of remanufacturing the pancake coil. Therefore, according to the superconducting device according to this aspect, compared with the conventional technique in which all pancake coils should be replaced, it is possible to repair the superconducting coil quickly at a low cost.

According to the aspects of the present invention described above, since the cooling substrate disposed on the end surface (a top surface or a bottom surface) of the pancake coil includes a plurality of cooling plates, the laminated pancake coils can be separated from each other by separating the cooling plates from each other. For this reason, it is possible to remove only a pancake coil in which a problem has occurred and replace the pancake coil with another new pancake coil. Accordingly, it is possible to minimize the damage in terms of time and cost required for replacement of the superconducting wire and the pancake coil and to minimize the number of steps required for remanufacturing the pancake coil. Therefore, according to the aspect of the present invention described above, compared with the conventional technique in which all pancake coils should be replaced, it is possible to repair the superconducting coil quickly at a low cost.

DETAILED DESCRIPTION OF THE PREFERRED EMBODIMENTS

Hereinafter, a superconducting magnet device including a superconducting coil according to an embodiment of the present invention will be described with reference to the diagrams. The present invention is not limited to the embodiment described below.

Figure 1:
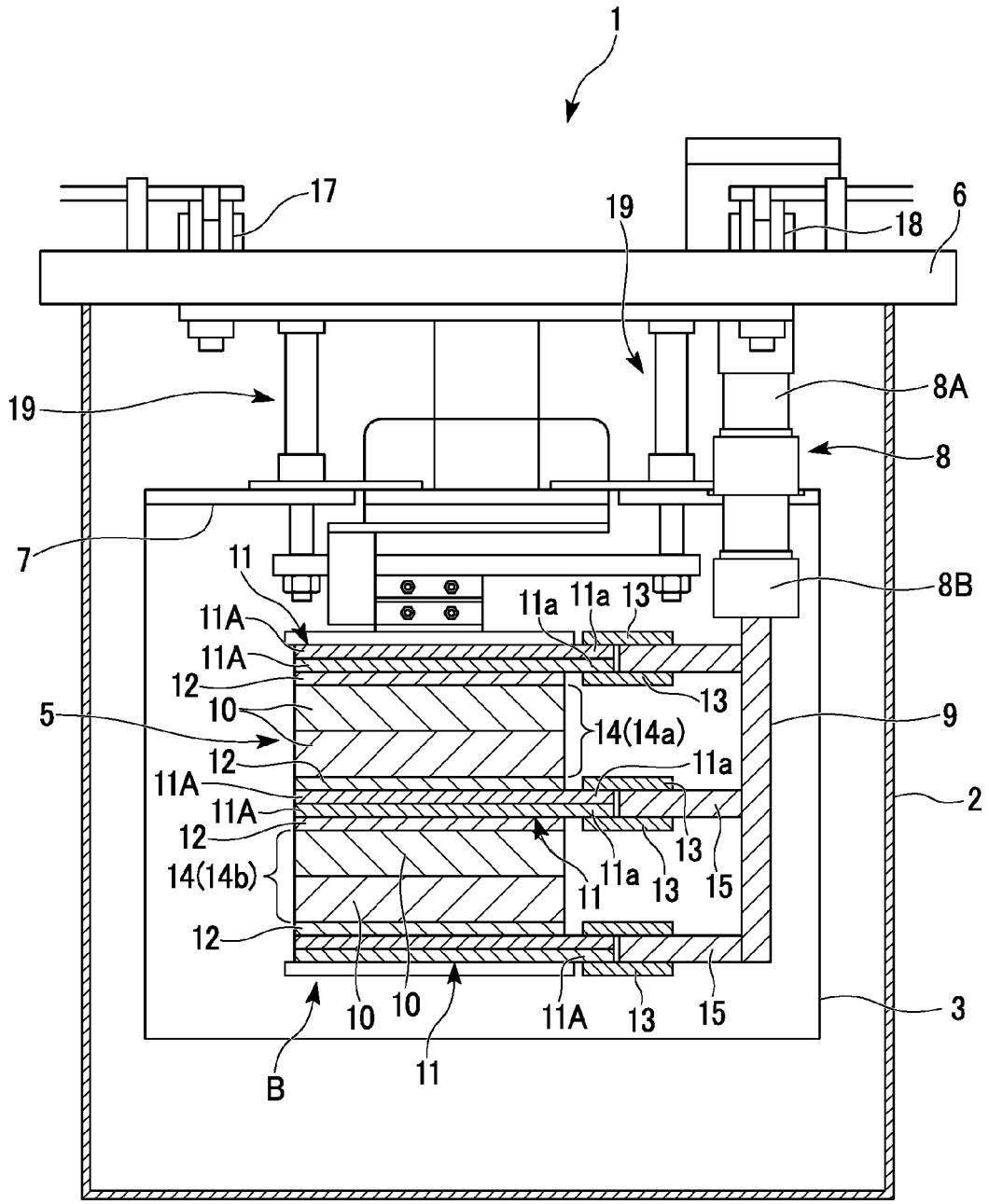
FIG. 1 is a plan view showing a superconducting magnet device including a superconducting coil according to an embodiment of the present invention.

A superconducting magnet device 1 shown in FIG. 1 includes an outer container 2 that can be decompressed, such as a vacuum container, an inner container (heat shield) 3 provided inside the outer container 2, a superconducting coil 5 housed in the inner container 3, a flange portion 6 that closes the top of the outer container 2, a flange portion 7 that closes the top of the inner container 3, and a freezing machine 8.

The freezing machine 8 has a two-stage structure including first and second stages 8A and 8B. A cooling plate 11A of the superconducting coil 5 is connected to a heat transfer body 9, which extends to the distal end of the second stage 8B and is formed in a rod shape, through three heat transfer members 15. Accordingly, the superconducting coil 5 is configured so as to be able to be cooled to the critical temperature or lower by the conduction cooling of the freezing machine 8.

In the example shown in FIG. 1, the superconducting coil 5 includes two pancake coils (two double pancake coils 14). Each pancake coil 14 includes two pancake coil elements 10, each of which has an oxide superconducting wire wound around a bobbin (not shown) and is laminated in a thickness direction thereof. More particularly, as shown in FIG. 1, the two pancake coil elements 10 are stacked in a thickness direction thereof such that the central axis positions match each other and the end surfaces are in contact with each other, and are inserted in a winding drum B2 of the bobbin B. The ring-shaped cooling plate 11A is disposed on each of the uppermost surface and the lowermost surface of the stacked pancake coil elements 10. The two stacked pancake coil elements 10 form the pancake coil 14.

In the structure shown in FIG. 1, the superconducting coil 5 includes the two pancake coils 14 laminated in a vertical direction, the cooling plate 11A disposed on the top surface of an upper double pancake coil (first pancake coil) 14*a*, the other cooling plate 11A stacked on the cooling plate 11A, the cooling plate 11A disposed on the bottom surface of the lower double pancake coil (second pancake coil) 14*b*, and the other cooling plate 11A stacked below the cooling plate 11A. On the cooling plate 11A disposed on the top surface of the lower double pancake coil (second pancake coil) 14*b*, the cooling plate 11A disposed on the bottom surface of the upper double pancake coil (first pancake coil) 14*a* is stacked.

Although the pancake coil interposed between the upper and lower cooling plates is a double pancake coil in the present embodiment, a single pancake coil may be used, or a single pancake coil may be stacked in three or more layers.

The cooling plate 11A is formed of a metal material having good thermal conductivity, and has a thickness of approximately one severalth millimeter to several millimeters. The metal material that forms the cooling plate 11A is not particularly limited, and can be appropriately changed. For example, the cooling plate 11A is formed of copper, such as oxygen-free copper, tough pitch copper, and brass, a copper alloy, aluminum, or an aluminum alloy.

The superconducting coil 5 shown in FIG. 1 includes the two laminated pancake coils 14 and the cooling plates 11A disposed on the uppermost surface and the lowermost surface of the two laminated pancake coils 14. That is, the superconducting coil 5 shown in FIG. 1 includes a cooling substrate 11 configured to include two cooling plates 11A disposed on the bottom surface of the lower double pancake coil 14*b*, a cooling substrate 11 configured to include two cooling plates 11A disposed between the upper double pancake coil 14*a* and the lower double pancake coil 14*b*, and a cooling substrate 11 configured to include two cooling plates 11A disposed on the top surface of the upper double pancake coil 14*a*. The two upper and lower cooling plates 11A forming the cooling substrate 11, which are in contact with the end surface of the pancake coil 14, are bonded and fixed to the end surface of the pancake coil 14 by impregnating resin (bonding element) 12, such as a glass fiber containing resin sheet or epoxy resin. As a method of bonding the pancake coil 14 to the cooling plate 11A, there is a method of fixing the cooling plate 11A with an adhesive after impregnating the pancake coil 14 with resin and a method of fixing the cooling plate 11A together when impregnating the pancake coil 14 with resin. In the former case, reference numeral 12 in the diagram indicates an adhesive. Epoxy resin or grease can be applied as the adhesive material, and it is preferable to use the epoxy resin. On the other hand, the two upper and lower cooling plates 11A that form the cooling substrate 11 simply overlap each other. That is, the two cooling plates 11A are laminated so as to be able to be separated from each other. Grease or the like may be interposed between the two upper and lower cooling plates 11A that form the cooling substrate 11 when necessary.

In addition, the number of cooling plates 11A fixed to the pancake coil 14 is not limited to two, and may be three or more as long as the cooling plates 11A can be separated from each other.

A protruding portion 11*a* that protrudes to the side of the pancake coil 14 is formed at one end (end close to the second stage 8B of the freezing machine 8) of the cooling plate 11A. A pair of heat transfer connection members 13 formed in a plate shape, between which distal portions of the protruding portions 11*a* of the cooling plates 11A overlapping each other in the vertical direction are interposed in the vertical direction, are provided on the uppermost surface and the lowermost surface in the distal portions of the protruding portions a. The heat transfer member 15 extending from the heat transfer body 9, which is present at a position close to the second stage 8B that forms the freezing machine 8, is interposed between a pair of heat transfer connection members 13. The heat transfer member 15 is connected to the second stage 8B of the freezing machine 8 through the heat transfer body 9 in order to perform conduction cooling from the second stage 8B that forms the freezing machine 8.

Although not shown in the diagram, a pair of heat transfer connection members 13, between which the protruding portions 11*a* are interposed in the vertical direction, and the protruding portions 11*a* are integrated by the bolt passing through the protruding portion 11*a* and the pair of heat transfer connection members 13 and the nut screwed to the bolt. The protruding portions 11*a* are interposed at one end of the pair of heat transfer connection members 13, and the heat transfer member 15 is interposed at the other end. By the bolt passing through the heat transfer member 15 and the pair of heat transfer connection members 13 and the nut screwed to the bolt, the pair of heat transfer connection members 13 and the heat transfer member 15 are integrated. The connection between the cooling plate 11A and the pair of heat transfer connection members 13 is not limited to the connection using the bolt and the nut, and it is also possible to use other connection structures.

The heat transfer body 9, the heat transfer connection member 13, and the heat transfer member 15 are formed of a metal material having good thermal conductivity. The metal material that forms the heat transfer body 9, the heat transfer connection member 13, and the heat transfer member 15 is not particularly limited, and can be appropriately changed. For example, the heat transfer body 9, the heat transfer connection member 13, and the heat transfer member 15 can be formed of copper, such as oxygen-free copper, tough pitch copper, and brass, a copper alloy, aluminum, or an aluminum alloy.

By connecting the protruding portion 11*a* formed in the cooling plate 11A to the second stage 8B thermally sufficiently through the pair of heat transfer connection members 13, the heat transfer member 15, and the heat transfer body 9 as described above, conduction cooling of the pancake coil 14 can be efficiently performed by the second stage 8B that forms the freezing machine 8.

In a conventional device, the cooling substrate 11 is formed using a single metal plate. On the other hand, in the present embodiment, the cooling substrate 11 is formed using the two cooling plates 11A. If the thickness of the cooling plate 11A is approximately ½ of the thickness of one metal plate in a conventional device, the total thickness of the superconducting coil 5 including the two stacked cooling plates 11A is the same as the total thickness of the superconducting coil having a conventional structure. For example, if the cooling plate 11A having a thickness of ½ of the thickness of the cooling substrate in a superconducting coil having a conventional structure is used, the current density of the entire superconducting coil 5 (=applied current×number of turns/cross-sectional area of the coil) is the same. Therefore, there is no influence on the coil characteristics, such as a reduction in the central magnetic field of the coil. In addition, even if the thickness of the cooling plate 11A is slightly larger than ½ of the thickness of the cooling substrate in a superconducting coil having a conventional structure, the influence on the thickness of the entire superconducting coil 5 is small. For this reason, a change in the coil current density due to the change in the coil height can also be slightly suppressed.

In the superconducting magnet device 1, external connection terminals 17 and 18 for supplying a current are formed so as to penetrate the flange portion 6. Lower ends of the external connection terminals 17 and 18 are pulled into the outer container 2, and are connected to an upper end of a current lead 19. A lower end of the current lead 19 is connected to an oxide superconducting wire (not shown) that forms each pancake coil 14 in the superconducting coil 5.

The outer container 2 is connected to a vacuum pump (not shown), so that the inside of the outer container 2 can be decompressed to the desired degree of vacuum. The external connection terminals 17 and 18 are connected to a power source (not shown), which is disposed outside the superconducting magnet device 1, through a current lead line, so that a desired magnetic field can be generated by the application of current from the power source to the superconducting wire in the superconducting coil 5.

As an example of the superconducting wire wound around the pancake coil 14, it is possible to use any superconducting wire that is generally referred to as a high-temperature superconducting wire, such as a rare earth element-based oxide superconducting wire, a Bi-based oxide superconducting wire, or an $MgB_2$ superconducting wire.

As the rare earth element-based oxide superconducting wire, a superconducting wire formed in a tape shape by laminating an intermediate layer, an oxide superconducting layer, a protective layer, and a stabilization layer on a metal-tape substrate can be illustrated.

The intermediate layer can have a multi-layer structure including a diffusion barrier layer or a bed layer as a base layer. As an alignment layer that is the main body of the intermediate layer, it is possible to use a thin film with good crystal orientation that is formed using a physical vapor deposition method, such as an ion beam assisted deposition method (hereinafter, abbreviated as an IBAD method). In order to obtain better crystal orientation, it is possible to provide a cap layer on the alignment layer.

When a thin film formed of rare earth element-based oxide superconductor is applied to the intermediate layer, $REBa_2Cu_3O_y$ (RE indicates rare earth elements, such as Y, La, Nd, Sm, Er, and Gd), specifically, Y123 ($YBa_2Cu_3O_y$), Gd123 ($GdBa_2Cu_3O_y$), or the like can be illustrated.

The protective layer formed so as to cover the surface of the oxide superconducting layer can be formed of Ag or an Ag alloy, and the stabilization layer laminated on the protective layer can be formed of Cu or a Cu alloy having good conductivity.

As an example of the Bi-based oxide superconducting wire, it is possible to use a superconducting wire that is formed in a tape shape by mixing a sintered body that can be expressed as BiSrCaCuO, such as a 2223 phase, inside a metal sheath formed of metal having good conductivity, such as Ag, and performing rolling.

As an example of the $MgB_2$ superconducting wire, it is possible to use a superconducting wire that is formed in a tape shape or a linear shape by including the powder of $MgB_2$ inside a metal pipe and forming multiple cores using a powder-in-tube method for reducing the diameter.

The superconducting magnet device 1 shown in FIG. 1 is used in such a manner that the inside of the outer container 2 is decompressed by a vacuum pump (not shown) to obtain a vacuum state, the freezing machine 8 is operated to cool the superconducting coil 5 to the critical temperature or lower by conduction cooling, and then a current is supplied from the external current source to the superconducting wire of the superconducting coil 5 through the external connection terminals 17 and 18. The freezing machine 8 has the ability to cool the superconducting coil 5 to a temperature lower than approximately 91 K at which a superconductor changes to a superconducting state, such as 4.2 K, 20 K, or 40 K, although it depends on the model.

The superconducting magnet device 1 shown in FIG. 1 is used by performing conduction cooling of the superconducting coil 5 to the critical temperature or lower through the heat transfer body 9, the three heat transfer members 15, and a plurality of cooling substrates 11, such as a plurality of heat transfer connection members 13, from the second stage 8B that forms the freezing machine 8.

In the superconducting magnet device 1, the cooling substrate 11 includes the two cooling plates 11A. The two cooling plates 11A simply overlap each other. For this reason, there is a possibility of the deterioration of thermal contact between the cooling plates 11A. However, the protruding portion 11*a* formed in the cooling plate 11A is integrated with a pair of heat transfer connection members 13 between which 11*a* is interposed in the vertical direction. That is, two cooling paths through a pair of heat transfer connection members 13 disposed on the uppermost surface and the lowermost surface of the protruding portions 11*a* are provided. Therefore, it is possible to separately perform conduction cooling of the cooling plate 11A from the heat transfer member 15 through the pair of heat transfer connection members 13. Accordingly, heat transfer efficiency of the cooling plate 11A is not reduced.

In addition, it is preferable to set the thickness of the cooling plate 11A to approximately ½ of the thickness of one cooling substrate in a conventional structure. However, when the cooling plate 11A is formed thicker, the thickness of the entire superconducting coil 5 is increased, but an increase in the thickness of the cooling plate 11A with respect to the thickness of the entire superconducting coil 5 is small. For this reason, a decrease rate of the number of windings in the oxide superconducting wire caused by the increase in the thickness of the superconducting coil 5 is very small, and a reduction in the current density of the superconducting coil 5 is small. Therefore, there is no adverse effect on the performance of the superconducting coil 5.

In the superconducting magnet device 1, when a problem occurs in the oxide superconducting wire, only the pancake coil 14 in which the problem has occurred in the superconducting wire between the two laminated pancake coils 14 shown in FIG. 1 can be replaced with the new pancake coil 14 manufactured separately.

For this reason, it is not necessary to replace the entire superconducting coil 5. Therefore, the pancake coil 14 in which no problem has occurred in the superconducting wire is not needlessly discarded.

Incidentally, although the superconducting coil 5 shown in FIG. 1 includes the two laminated pancake coils 14, the superconducting coil 5 may include three or more laminated pancake coils 14.

In addition, although the superconducting coil 5 shown in FIG. 1 includes the double pancake coil 14 as the first and second pancake coils 14*a* and 14*b*, the superconducting coil 5 may include a single pancake coil or a pancake coil, which has three or more laminated pancake coil elements, as the first and second pancake coils 14*a* and 14*b*.

In addition, although the superconducting coil 5 shown in FIG. 1 includes the two laminated pancake coils 14 and the cooling substrate 11 provided in contact with the end surface of the pancake coil 14 and each pancake coil 14 has the two laminated pancake coil elements 10, the superconducting coil 5 is not limited to such a structure. For example, it is possible to use a superconducting coil including a plurality of laminated single pancake coils and the cooling substrate 11 that is provided in contact with the top and bottom surfaces of each single pancake coil.

Figure 2:
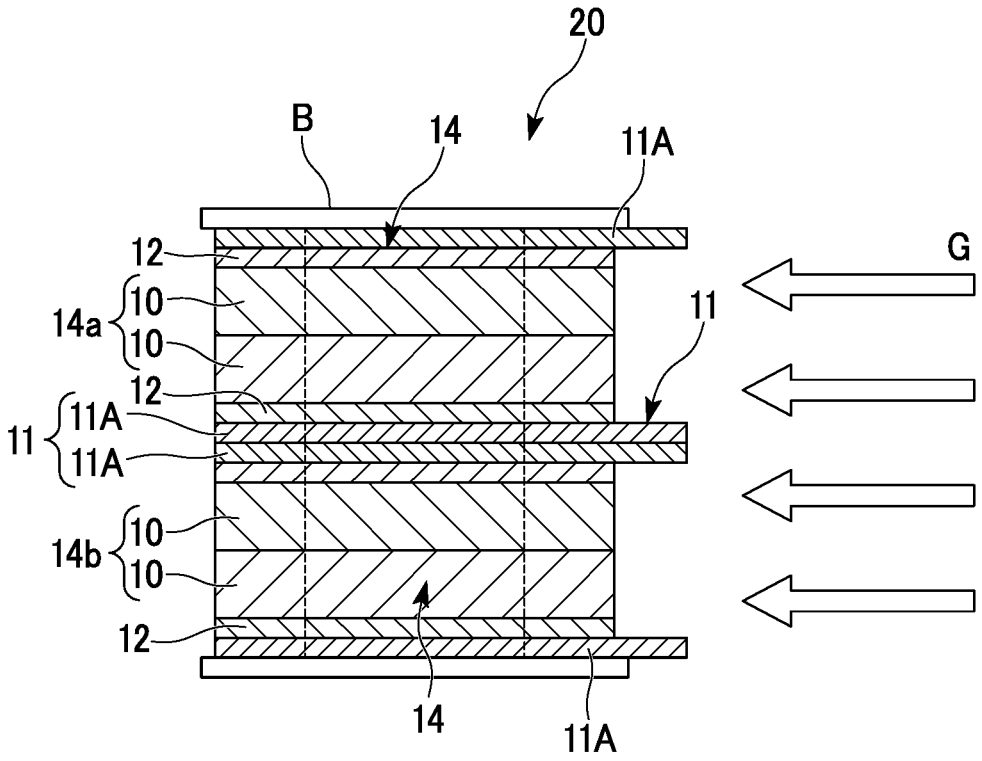
FIG. 2 is a side view showing a structural example of a superconducting coil based on a cooling method using gas.
Figure 3A:
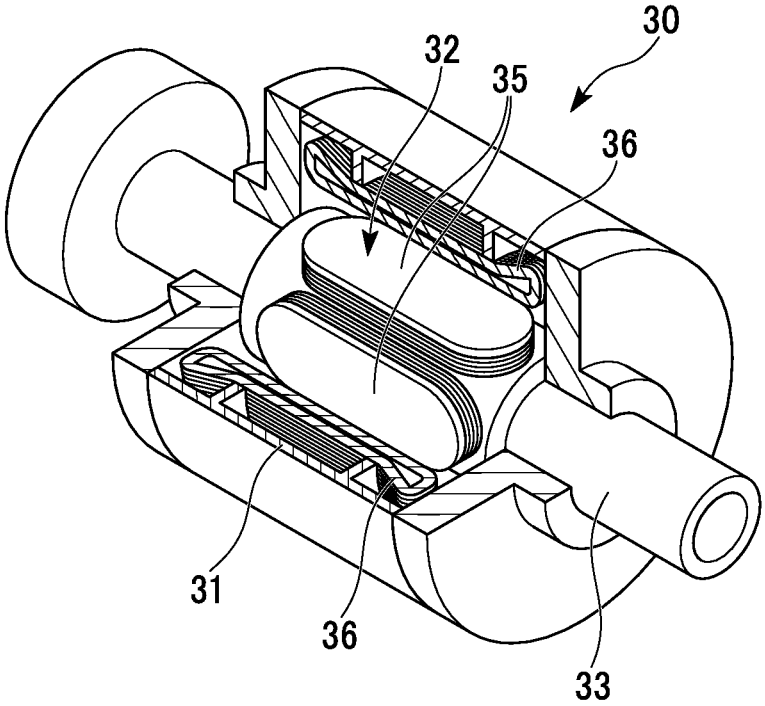
FIG. 3A is a partial sectional view showing an example of the overall configuration of a superconducting motor including the superconducting coil.
Figure 3B:
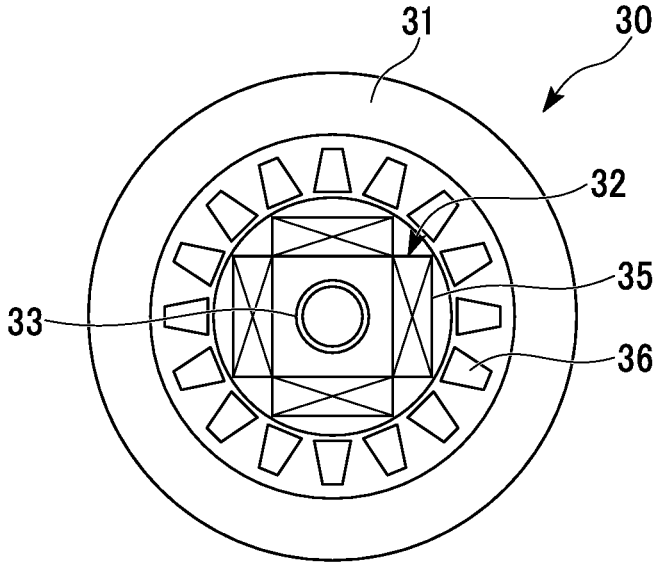
FIG. 3B is a diagram showing an example of the arrangement relationship of a superconducting coil and a rotor in the superconducting motor including the superconducting coil.
Figure 4:
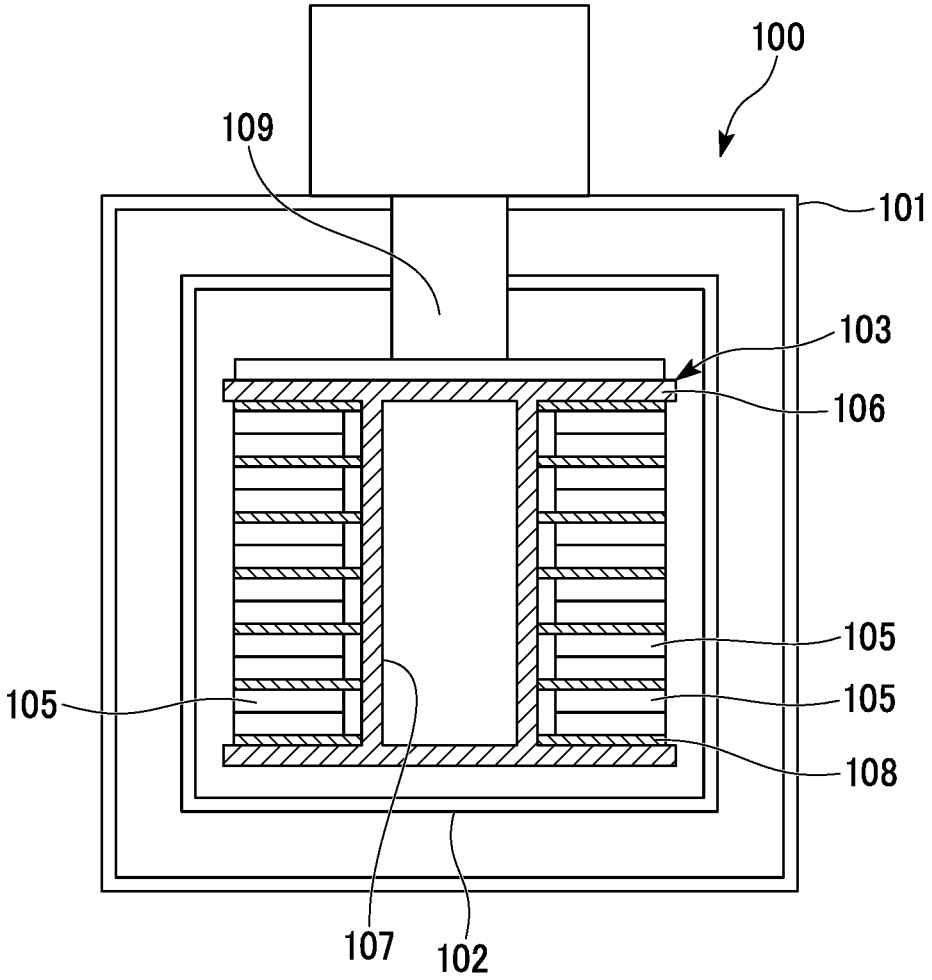
FIG. 4 is a cross-sectional view of a superconducting magnet device including a conventional superconducting coil.

FIG. 2 shows the structure of a superconducting coil according to an embodiment of the present invention that corresponds to a gas cooling method. FIGS. 3A and 3B show an example of a superconducting motor (superconducting device) to which a superconducting coil 20 having this structure is applied.

The superconducting coil 20 shown in FIG. 2 includes two vertically stacked pancake coils 14 that are inserted in the winding drum B2 of the bobbin B, a cooling plate 11A provided on each of the top surface of an upper double pancake coil (first pancake coil) 14*a* and the bottom surface of a lower double pancake coil (second pancake coil) 14*b*, and a cooling substrate 11 that is provided between the upper double pancake coil (first pancake coil) 14*a* and the lower double pancake coil (second pancake coil) 14*b* and is configured to include the two cooling plates 11A.

The superconducting coil 20 shown in FIG. 2 can be used in such a manner that cooling gas G, such as helium gas, is blown into the side surface of the pancake coil 14 as indicated by the arrow in this diagram and is cooled to cool the superconducting wire of the pancake coil element 10 to the critical temperature or lower.

The superconducting coil 20 shown in FIG. 2 is applied to a superconducting motor (superconducting device) 30 having a structure shown in FIGS. 3A and 3B, for example. The superconducting motor 30 shown in FIGS. 3A and 3B includes a shaft type rotor 32 that is rotatably provided inside a closed type horizontally long container 31 formed in a cylindrical shape, and is configured so that cooling gas, such as helium gas, can be supplied to the inside of the container 31.

A plurality of superconducting coils 35 are attached around a central portion of a rotary shaft 33. A plurality of normal conduction coils 36 formed by copper coils supported by the inner wall of the container 31 are disposed around the plurality of superconducting coils 35.

A plurality of pipes for inflow and outflow of cooling gas are provided inside the rotary shaft 33. Therefore, the superconducting coil 35 can be cooled to the critical temperature or lower by the cooling gas that is introduced from a refrigerant supply device (not shown), which is separately provided outside the superconducting motor 30, into the container 31 through the plurality of pipes. Although the superconducting coil 35 is cooled to the critical temperature or lower, the normal conduction coil 36 is held at room temperature.

As shown in FIGS. 3A and 3B, the superconducting coil 35 can be disposed so as to be laminate around the rotary shaft 33. The superconducting coil 20 shown in FIG. 2 can be adopted as the superconducting coil 35.

The superconducting motor 30 shown in FIGS. 3A and 3B is used in such a manner that the superconducting coil 35 is cooled to the critical temperature or lower by using the cooling gas introduced into the container 31. The superconducting motor 30 can be used in such a manner that the rotary shaft 33 is rotated by the magnetic field generated by the normal conduction coil 36 and the superconducting coil 35 to which required current from a separate power source (not shown) is supplied.

When a problem occurs in a superconducting wire assembled in any of the superconducting coils 35 for some reason during the use of the superconducting motor 30 shown in FIGS. 3A and 3B and the superconducting motor 30 is repaired, only the pancake coil 14 including the superconducting wire in which the problem has occurred may be replaced if the structure of the superconducting coil 35 is the same as the structure of the superconducting coil 20 shown in FIG. 2. That is, it is possible to repair the superconducting motor 30 by replacing only the pancake coil 14, which is a piece of the superconducting coil 35, without replacing the entire superconducting coil 35.

FIG. 2 shows an example of the bobbin that forms the superconducting coil according to an embodiment of the present invention.

The bobbin B shown in FIG. 2 includes a pair of upper and lower flange portions B1, between which the first and second pancake coils 14*a* and 14*b* are interposed in the thickness direction, and the winding drum (body portion) B2, which is provided between the pair of upper and lower flange portions B1 and is inserted in the first and second pancake coils 14*a* and 14*b*.

It is preferable that the thermal expansion coefficients of the flange portion B1 and the winding drum (body portion) B2, which form the bobbin B shown in FIG. 2, be larger than the thermal expansion coefficient of the first pancake coil 14*a*, the thermal expansion coefficient of the second pancake coil 14*b*, and the thermal expansion coefficient of the cooling substrate 11. In this case, the amount of shrinkage in the thickness direction of the first and second pancake coils 14*a* and 14*b* and the cooling substrate 11 during cooling of the first pancake coil 14*a* and the second pancake coil by the cooling substrate 11 is smaller than the amount of shrinkage of the winding drum (body portion) B2. For this reason, there is no concern for an increase in the distance between pancake coils during cooling. Therefore, it is possible to further enhance the superiority of this structure without a change in the density of the coil even during cooling, that is, without a change in the critical current density of the coil. As a material for forming the bobbin B, GFRP, aluminum, or the like is preferable since each has a large linear expansion coefficient.

Figure 5:
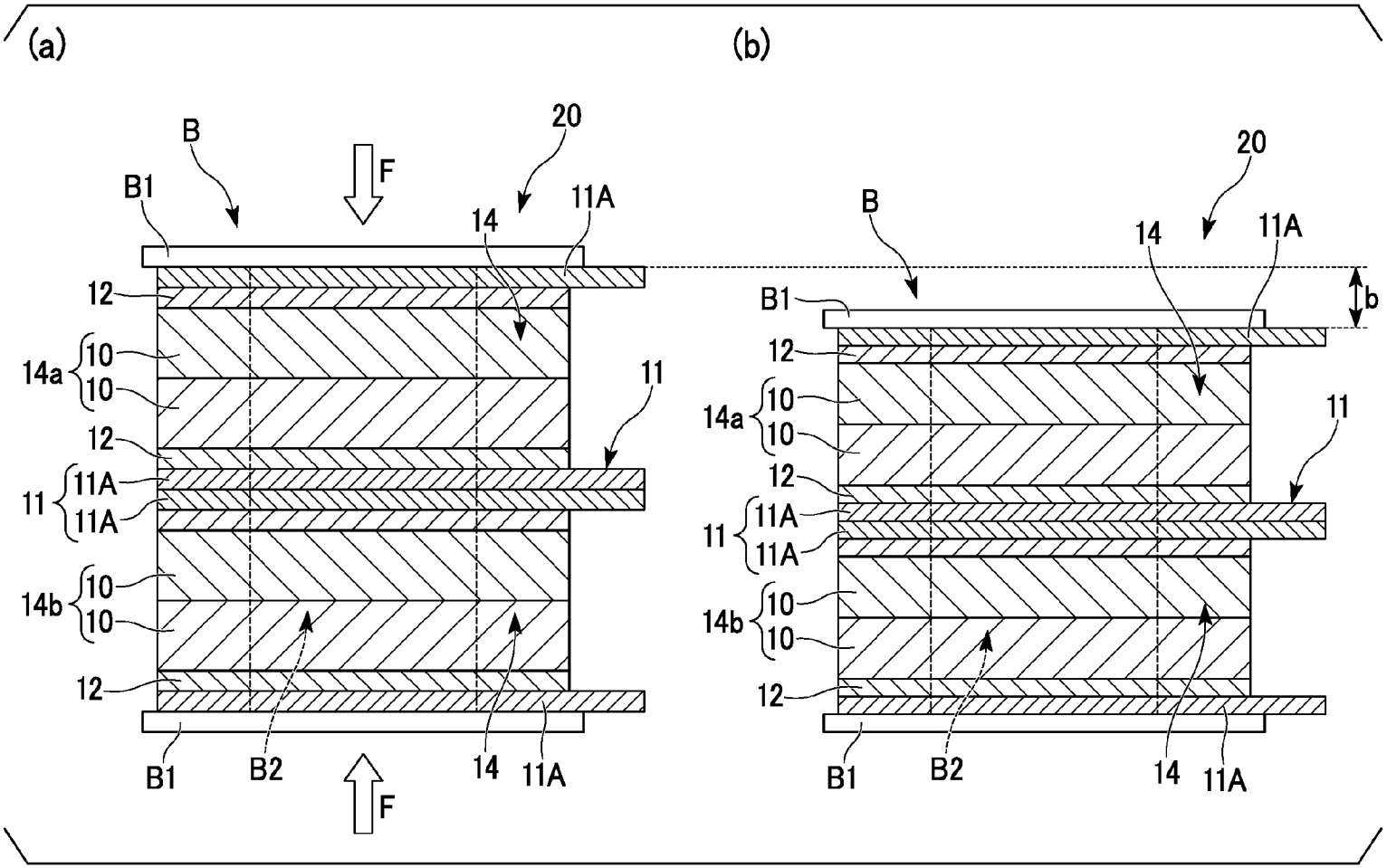
FIG. 5 is a diagram showing an example of a superconducting coil according to an embodiment of the present invention in which first and second pancake coils 14*a* and 14*b* and a cooling substrate 11 are compressed in a thickness direction.

FIG. 5 shows an example of a superconducting coil according to an embodiment of the present invention in which the first and second pancake coils 14*a* and 14*b* and the cooling substrate 11 are compressed in the thickness direction.

As shown in FIG. 5, the superconducting coil 20 is compressed (pressed) by the amount of shrinkage b in the thickness direction by fixed pressure F. Here, it is preferable that the amount of shrinkage b be larger than the sum a of the amount of shrinkage in the thickness direction of the first and second pancake coils 14*a* and 14*b* and the cooling substrate 11 during cooling of the first and second pancake coils 14*a* and 14*b*. In this case, there is no concern for an increase in the distance between pancake coils during cooling. Therefore, it is possible to further enhance the superiority of this structure without a change in the height of the coil even during cooling, that is, without a change in the critical current density of the coil. As a mechanism for pressing the superconducting coil with the fixed pressure F described above, it is preferable to use a disc spring, an extension spring, or the like for a flange bolt for fixing a pair of upper and lower flanges.

EXAMPLES

A superconducting coil having a structure shown in Table 1 below was manufactured.

An oxide superconducting wire having a total thickness of approximately 0.23 mm configured to include a tape-shaped substrate having a width of 5 mm and a thickness of 0.1 mm that was formed of Hastelloy C276 (product name of U.S. Haynes Co.) and a diffusion barrier layer of $Al_2O_3$ having a thickness of 100 nm, a bed layer of $Y_2O_3$ having a thickness of 30 nm, an alignment layer of MgO having a thickness of 10 nm, a cap layer of $CeO_2$ having a thickness of 500 nm, an oxide superconducting layer of $GdBa_2Cu_3O_{7-x}$ having a thickness of approximately 2 μm, a protective layer of Ag having a thickness of 10 μm, and a copper-bonded tape having a thickness of 100 μm, which were provided on the surface of the substrate, was prepared.

A pancake coil was formed by turning the above-described superconducting wire 100 turns around the winding drum and a winding portion was impregnated with epoxy resin and was cured, thereby forming a superconducting coil. Then, the superconducting coil was immersed into liquid nitrogen and a critical current was measured. Then, the superconducting coil was assembled into the superconducting magnet device having the structure shown in FIG. 1, and was evaluated under conduction cooling.

The specification is shown in Table 1 below.

TABLE 1

| Items | Conventional structure | Exemplary structure |
|---|---|---|
| Inner diameter of coil (mm) | 60 | 60 |
| Outer diameter of coil (mm) | 131 | 131 |
| Number of turns/pancake | 100 | 100 |
| Number of pancake laminations | 6 | 6 |
| Glass fiber reinforced resin sheet | 0.25 mm in thickness | 0.25 mm in thickness |
| Thickness | Cooling substrate: 1.0 mm | Cooling plate: 0.5 mm |
| Number of sheets | Four cooling substrates | Eight cooling plates |
| Measured temperature | 50 K | 50 K |
| Central magnetic field | 1.25T@166 A | 1.25T@166 A |

From the result shown in Table 1, a result was obtained in which the value of the central magnetic field and characteristics as a superconducting magnet device were the same between the conventional superconducting coil and the superconducting coil of this example. According to the structure of this example, two cooling plates that form the cooling substrate can be separated from each other. Accordingly, when a problem occurs in one of the pancake coils, only the pancake coil in which the problem has occurred is replaced. Therefore, since it is not necessary to replace all pancake coils in the superconducting magnet device of this example, the superconducting magnet device of this example is advantageous when fixing the superconducting magnet device compared with a superconducting magnet device having a conventional structure.

What is claimed is:

1. A superconducting coil, comprising:

first and second pancake coils that are formed by winding a superconducting wire, are stacked in a thickness direction, and are adjacent to each other;

a cooling substrate that is interposed between the first and second pancake coils and is formed of a plurality of cooling plates, the plurality of the cooling plates overlapping in a contact state and being separable from each other, cooling plates that are disposed on the uppermost surface and the lowermost surface of the first and second pancake coils, and a bonding element that bonds at least a pair of upper and lower cooling plates and the first pancake coil to each other and bonds at least a pair of upper and lower cooling plates and the second pancake coil to each other, wherein the cooling plates are formed of a metal material, and the first and second pancake coils are separable from each other by separation between the plurality of the cooling plates.

2. The superconducting coil according to claim 1, further comprising:

a freezing machine connected to the cooling substrate through a heat transfer member; and a heat transfer connection member that is provided in each of the plurality of cooling plates and is connected to the heat transfer member.

3. The superconducting coil according to claim 1, further comprising:

a bobbin including a pair of upper and lower flange portions, between which the first and second pancake coils are interposed in the thickness direction; and a body portion that is provided between the pair of upper and lower flange portions and is inserted in the first and second pancake coils, wherein thermal expansion coefficients of the flange portions and the body portion are larger than thermal expansion coefficients of the first and second pancake coils and a thermal expansion coefficient of the cooling substrate.

4. The superconducting coil according to claim 2, further comprising:

a bobbin including a pair of upper and lower flange portions, between which the first and second pancake coils are interposed in the thickness direction; and a body portion that is provided between the pair of upper and lower flange portions and is inserted in the first and second pancake coils, wherein thermal expansion coefficients of the flange portions and the body portion are larger than thermal expansion coefficients of the first and second pancake coils and a thermal expansion coefficient of the cooling substrate.

5. The superconducting coil according to claim 1, further comprising:

a bobbin including a pair of upper and lower flange portions, between which the first and second pancake coils are interposed in the thickness direction, and a body portion that is provided between the pair of upper and lower flange portions and is inserted in the first and second pancake coils, wherein the first and second pancake coils and the cooling substrate are interposed between the pair of upper and lower flange portions so as to be compressed in the thickness direction by an amount larger than an amount of shrinkage in the thickness direction of the first and second pancake coils and the cooling substrate during cooling of the first and second pancake coils by the cooling substrate.

6. The superconducting coil according to claim 2, further comprising:

a bobbin including a pair of upper and lower flange portions, between which the first and second pancake coils are interposed in the thickness direction, and a body portion that is provided between the pair of upper and lower flange portions and is inserted in the first and second pancake coils, wherein the first and second pancake coils and the cooling substrate are interposed between the pair of upper and lower flange portions so as to be compressed in the thickness direction by an amount larger than an amount of shrinkage in the thickness direction of the first and second pancake coils and the cooling substrate during cooling of the first and second pancake coils by the cooling substrate.

7. A superconducting device, comprising:

the superconducting coil according to claim 1;

an inner container surrounding the superconducting coil;

a vacuum container surrounding the inner container; and a freezing machine passing through the vacuum container and the inner container, wherein the cooling substrate is connected to a tip of the freezing machine, which extends to an inside of the inner container, through a heat transfer member.

* * * * *